US006629572B2

(12) United States Patent
Womer et al.

(10) Patent No.: US 6,629,572 B2
(45) Date of Patent: Oct. 7, 2003

(54) OPERATOR WORKSTATION FOR USE ON A DRILLING RIG INCLUDING INTEGRATED CONTROL AND INFORMATION

(75) Inventors: Keith A. Womer, Round Rock, TX (US); W. Dave Harbour, Scotland (GB); John Kracik, Fullerton, CA (US); David Ford, Aberdeenshire (GB)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 09/376,766

(22) Filed: Aug. 17, 1999

(65) Prior Publication Data

US 2002/0060093 A1 May 23, 2002

Related U.S. Application Data

(60) Provisional application No. 60/096,723, filed on Aug. 17, 1998.

(51) Int. Cl.[7] ..... E21B 44/00
(52) U.S. Cl. ..... 175/219; 175/24
(58) Field of Search ..... 175/219, 24; 296/190.01, 296/190.08; 700/83, 84, 85; 976/DIG. 207

(56) References Cited

U.S. PATENT DOCUMENTS

| | | | | |
|---|---|---|---|---|
| 4,432,064 A | | 2/1984 | Barker et al. | |
| 4,507,735 A | * | 3/1985 | Moorehead et al. | 324/323 |
| 4,725,106 A | | 2/1988 | Shields et al. | |
| 4,740,779 A | * | 4/1988 | Cleary et al. | 340/705 |
| 4,794,534 A | * | 12/1988 | Millheim | 175/40 |
| 4,957,690 A | * | 9/1990 | Fennern | 376/216 |
| 5,086,869 A | * | 2/1992 | Newbery et al. | 180/329 |

(List continued on next page.)

FOREIGN PATENT DOCUMENTS

| | | | |
|---|---|---|---|
| EP | 0 372 924 A2 | | 12/1988 |
| EP | 0 643 935 A1 | | 9/1993 |
| WO | 9700106 | * | 1/1997 |

OTHER PUBLICATIONS

Westermark et al., "Amoco Opens Drilling Test Facility to Industry", Apr. 1997, Oil & Gas Journal, pp. 66–70.*
Bourgois, "The MDS System: Computers Transform Drilling", Jan. 1990, Oilfield Review, V. 2, No. 1, pp. 4–15.*

*Primary Examiner*—Thomas B. Will
*Assistant Examiner*—Nathan Mammen
(74) *Attorney, Agent, or Firm*—Madan, Mossman & Sriram, P.C.

(57) ABSTRACT

A drilling rig system including a man-machine workstation interface located in proximity to the drilling rig for providing to a single operator at substantially one location simultaneous operational access to drilling rig processes. The workstation includes an adjustable base and an operator alcove formed on the base in which an operator is positioned allowing for a substantially unobstructed view of the drilling rig. Adjustable forearm support panels are formed on opposing sides of the operator alcove for supporting the forearms of the operator while positioned in the alcove. At least one display unit is adjustably connected to the base and has a touch access screen adapted to allow the operator to monitor and control drilling rig processes. A plurality of discrete hand controls are used for controlling predetermined drilling rig processes wherein at least one of the discrete hand controls is located on the forearm support panels. Preferably, an operator chair is positioned in the alcove and is slideably connected to the base permitting seating and standing operation of the workstation. Data from multiple associated drilling equipment is integrated with data from a current drilling rig process to provide data to the operator on a process oriented basis displayed on said display units.

8 Claims, 9 Drawing Sheets

U.S. PATENT DOCUMENTS 5,174,223 A 12/1992 Nagy et al.
5,358,058 A * 10/1994 Edlund et al. ..... 175/24
5,416,666 A * 5/1995 Maguire, Jr. ..... 361/681
5,536,070 A * 7/1996 Lemmen ..... 297/411.36
5,674,127 A * 10/1997 Horstmann et al. ..... 463/42
5,777,896 A * 7/1998 Arita et al. ..... 364/550
5,794,720 A * 8/1998 Smith et al. ..... 175/39
5,857,415 A * 1/1999 Richard ..... 108/50.01
6,012,016 A * 1/2000 Bilden et al. ..... 702/12
6,029,951 A * 2/2000 Guggari ..... 254/269
6,095,263 A * 8/2000 Saunders et al. ..... 175/219
6,446,738 B1 * 9/2002 Boyd ..... 175/219

* cited by examiner

200

220

225

245

255

285

OPERATOR WORKSTATION FOR USE ON A DRILLING RIG INCLUDING INTEGRATED CONTROL AND INFORMATION

CROSS REFERENCE TO RELATED APPLICATION

This application is related to U.S. Provisional Application No. 60/096,723 for "Operator Workstation for Use on a Drilling Rig Including Integrated Control and Information" filed on Aug. 17, 1998, the entire specification of which is hereby incorporated herein by reference.

BACKGROUND OF THE INVENTION

1. Field of the Invention

The system of the present invention is related to the use of operator consoles or workstations at a drilling rig site for monitoring and controlling drilling rig operations.

2. Description of the Related Art

In the oil and gas drilling industry, conventional operator's or driller's consoles or workstations present all of the data and control mechanisms for every element of drilling machinery to the driller or assistant driller at all times. Typically this data, in the form of switches, knobs, dials, meters, lights, indicators and joysticks, is integrated into the console with little regard to ergonomics and the prevention of information overload. Typically various control panels were provided by different tool and equipment vendors, each of whom applied their own ergonomic principles to the design of the particular control panels. The driller's console was based on the layout of these discrete building blocks. Secondary data and controls were provided adjacent to the primary data, but due to the physical layout of the console they result in occupying the peripheral vision of the operators at extreme reaches from the control position.

A result of this approach was that when the operator performed any of the drilling processes, such as making a connection, tripping, circulating, etc., the data relevant to that process was fragmented across many control panels and was not contained within the driller's primary vision. Further compounding this problem is that the panels are built with discrete controls present on the panel for all of the data associated with a particular tool or piece of equipment. As a result the operator must filter out the data needed just to perform any one process while still monitoring other events associated with the current process. Further effects of this approach resulted in consoles, and subsequently the driller's cabins, with larger footprints that required more complex cabling and correspondingly increased weight.

Numerous advantages are achieved with the operator workstation and integrated control and information system of the present invention, which provides for a smaller, lighter, more ergonomically designed workstation focused on functionality relevant to the current drilling operation on a process oriented basis as opposed to focusing on a tool orientation. The system of the present invention provides for data from a current process to be presented to the operator within the operator's primary vision, while allowing events associated with the current process (i.e. alarms, interlock messages, etc.) to be monitored and displayed on an event basis.

SUMMARY OF THE INVENTION

The drilling rig system of the present invention for monitoring and controlling operations on a drilling rig includes a man-machine workstation interface located in proximity to the drilling rig for providing to a single operator at substantially one location simultaneous operational access to drilling rig processes. The workstation includes an adjustable base and an operator alcove formed on the base in which an operator is positioned allowing for a substantially unobstructed view of the drilling rig. Adjustable forearm support panels are formed on opposing sides of the operator alcove for supporting the forearms of the operator while positioned in the alcove. At least one display unit is adjustably connected to the base and has a touch access screen adapted to allow the operator to monitor and control drilling rig processes. A plurality of discrete hand controls are used for controlling predetermined drilling rig processes wherein at least one of the discrete hand controls is located on the forearm support panels. Preferably, an operator chair is positioned in the alcove and is slideably connected to the base permitting seating and standing operation of the workstation. Data from multiple associated drilling equipment is integrated with data from a current drilling rig process to provide data to the operator on a process oriented basis displayed on said display units within the operator's primary vision.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION OF THE PREFERRED EMBODIMENTS

Figure 1:
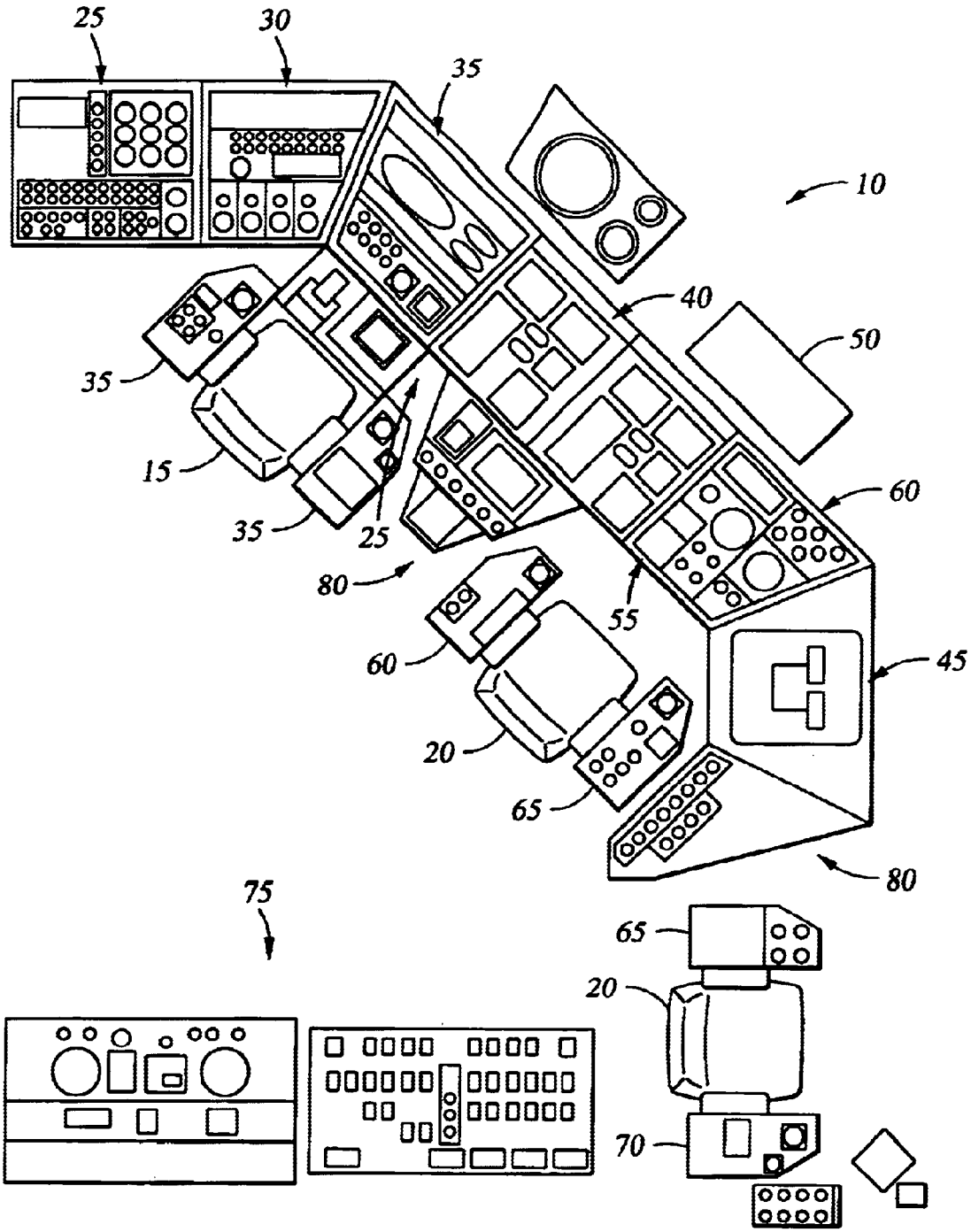
Fig. 1 (PRIOR ART)
FIG. 1 (labeled prior art) is a top view of typical operator's consoles as used in the drilling industry.

FIG. 1 (labeled prior art) is a top view of a typical operator's console 10 including a driller's station or chair 15 and one or more assistant driller's stations or chairs 20 as used in the drilling industry. The operator's console 10 is located in close proximity to a drilling rig in order for the operator to visually monitor and control the operations performed on the drilling rig. The layout of the controls, as illustrated, is based upon tool and equipment vendor. The tools and equipment represented in the typical operator's console 10 as shown in FIG. 1 are a drawworks panel 25, a silicon controlled rectifier unit (SCR) panel 30, a top drive panel 35, a drilling instrumentation panel 40, a mud system control panel 45, a closed circuit television (CCTV) 50, an iron roughneck panel 55, a pipe racker panel 60, a pipe conveyor panel 65, a pipe deck machine panel 70, a blowout-preventer (BOP) panel 75, and an auxiliary panel 80. Each panel includes discrete controls, gauges, and monitors for facilitating the control and monitoring of operations performed on the drilling rig.

Typically, many of the controls and panels in the operator's console 10 are supplied by different vendors making the control type, orientation, and function of the controls and panels unique to each subsystem supplied. For example, hydraulic gauges are used to monitor certain functions while electric gauges are used to monitor other functions. Among the electric gauges, three different formats are typically used including analog gauges, digital gauges and bar graphs. Although efforts have been made in the past to optimize the panel layout for primary and peripheral operator vision, the data, as it pertains to each process or operation on the drilling rig rig, is fragmented across multiple panels. Alarm and status indicators also appear across multiple panels oriented to tools rather than particular processes or operations. The fragmentation of the information form the drilling rig processes, as well as the status and alarm indicators, requires the operator to continually scan the complete console to monitor and/or control drilling rig operations or processes. For many drilling rig processes, the operator is required to operate and monitor controls on multiple panels and maintain visual contact with both the operations at the drilling rig as well as the multiple panels to insure the drilling rig processes are performed correctly and safely.

Figure 2:
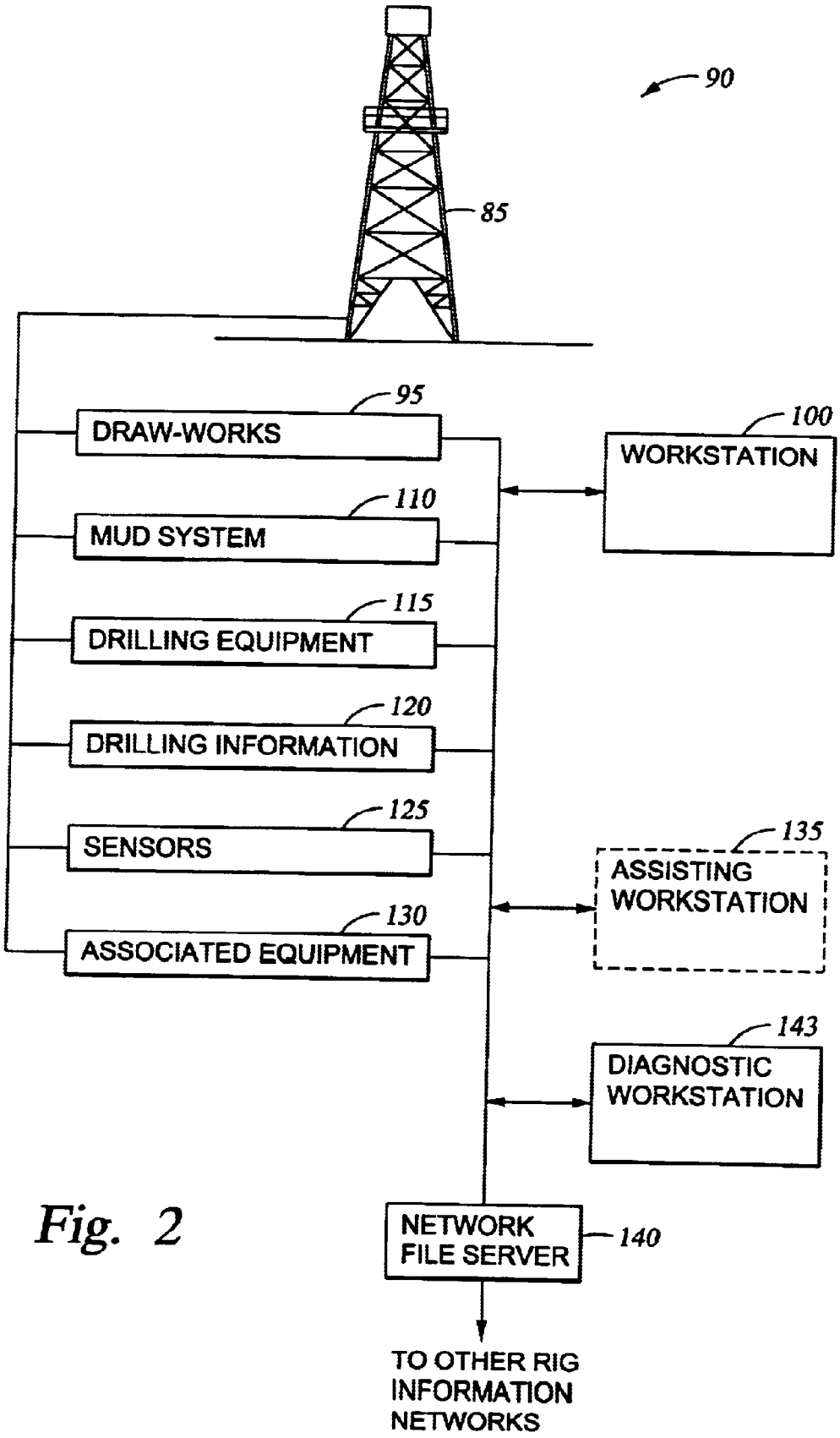
FIG. 2 is a block diagram illustrating a drilling rig system according to the present invention.

FIG. 2 is a block diagram illustrating a drilling rig system and an operator's workstation 100 according to the present invention including a drilling rig 85 at a rig site 90 wherein data from the drilling rig operations is acquired and the driller or operator monitors and controls the drilling rig operations on the rig site 90. In the present invention, drilling may be accomplished in a number of modes. The workstation 100 is located in proximity to the drilling rig 85 to allow the operator to visually monitor operations on the drilling rig floor. Information from the drilling rig system operations including, for example, a drawworks system 95 including a brake arrangement, a drilling mud circulating system 110, an automated drilling equipment system 115 including a top drive or rotary drive, a drilling rig information system 120 including weight-on-bit (WOB), rate-of-penetration (ROP) and hook load during the drilling process, sensors 125, and other associated equipment 130 including equipment from multiple vendors is provided to the operator at the workstation 100 on a process oriented basis. In another embodiment of the drilling rig system of the present invention, a second workstation 105, monitored by an assistant driller, also receives the information from the drilling rig operations to prevent inadvertent operation of a critical control function and for confirmation of any critical operation or process.

The information acquired from the rig site 90 is displayed at the workstation 100 on a process oriented basis using one or more display units which incorporate touch screen access. The operator controls the drilling rig processes through the use of the touch screen display units and discrete controls on the workstation 100, described in greater detail in FIGS. 3–5. The drilling rig process information displayed is structured to reduce the quantity of data that must be mentally processes by the operator (to minimize stimulus overload, while allowing rapid comprehension and ease-of-access to all relevant data. The display of the drilling rig process information is designed to support the role of the operator so he is more focused on the current operational tasks, rather than data gathering. The process oriented display of the rig site information relieves the operator of the necessity of scanning many parameters located on dispersed control panels, while simultaneously trying to control and mentally assemble a cohesive picture of the current drilling rig operation. The data from the various multiple associated drilling equipment is integrated with the data from the current drilling rig process to provide information on a process oriented basis displayed on the display units to allow a single operator at substantially one location simultaneous operational access to drilling rig processes.

To provide common access to the data required for each of the drilling processes, the system requires an architecture that allows data and control to be shared between the various drilling equipment. For example, as illustrated in FIG. 2, a connectivity is provided between the workstations 100 and 135, respectively, and the various drilling equipment and systems described through the use of a control network which utilizes, for example, a Fiber Dual Data Interchange (FDDI) configured in a dual star arrangement, providing a fault tolerant, redundant, noise immune, high speed, fiber optic network. The interface to the various drilling equipment is achieved, for example, through the use of a diagnostic workstation 143 that provides a gateway between the drilling equipment, the control network and the workstations 100 and 135, respectively. Operator control and data is transferred between the 100 and 135, respectively, and the diagnostic workstation 143, while the actual control of the individual tools remains within the equipment control systems. The diagnostic workstations 143 also provides additional functionality such as maintenance, troubleshooting and online documentation of drilling equipment. The architecture also includes a network file server 140 which provides such functions as archival of drilling data, a data exchange point with other data consumers and providers both on and off the rig site, and firewall protection for the control network.

Figure 3:
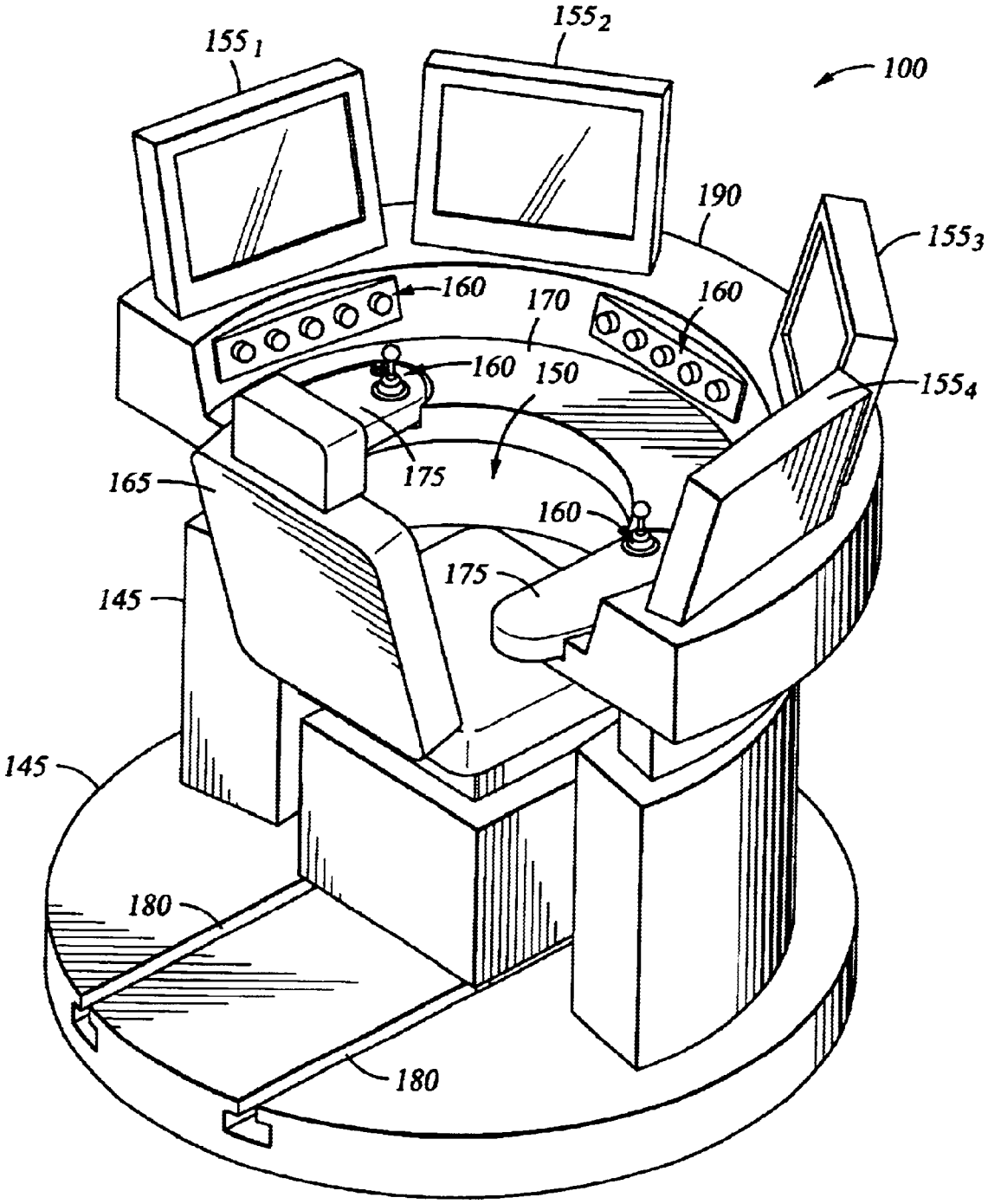
FIG. 3 is an elevation view illustrating a preferred embodiment of the operator's workstation of the present invention.
Figure 4:
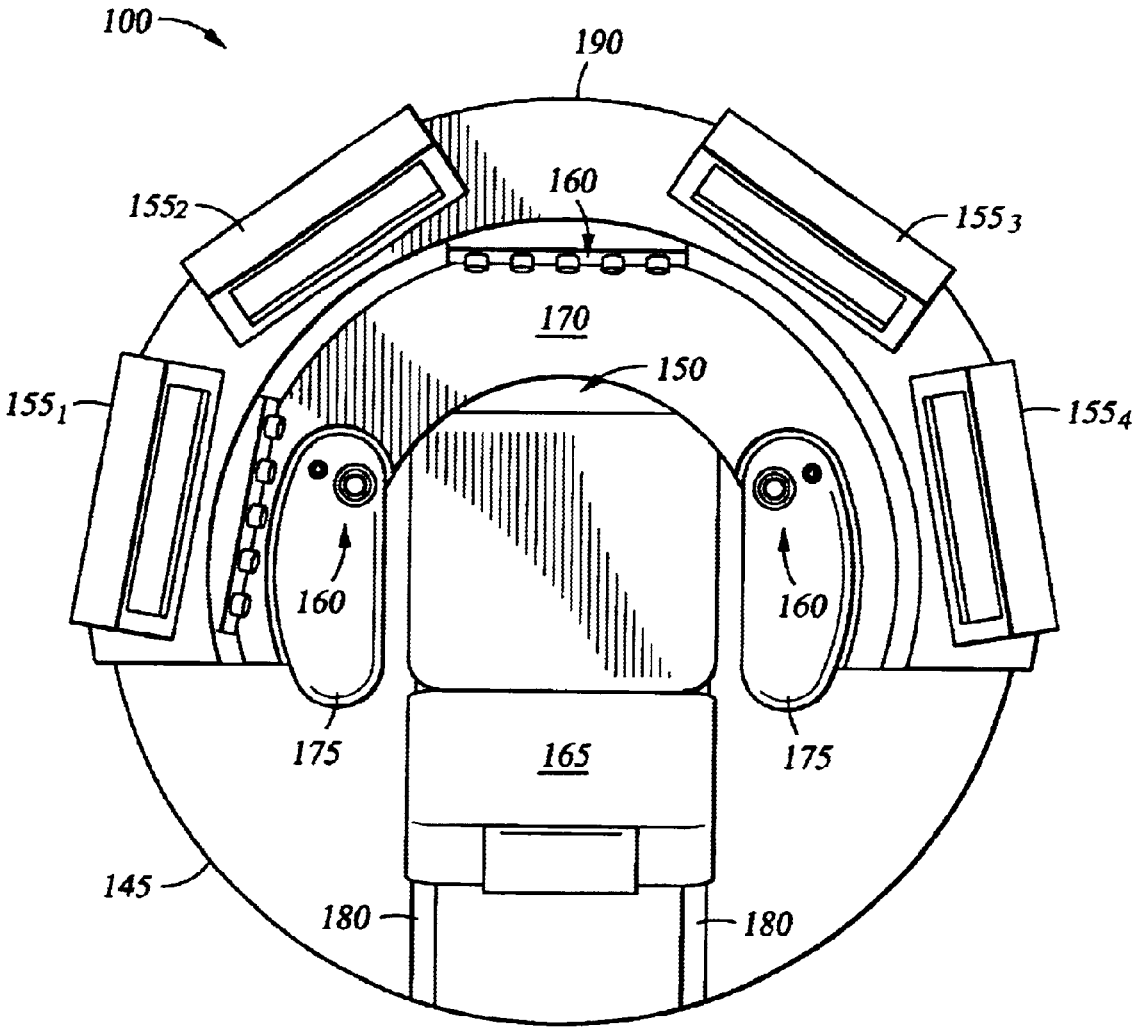
FIGS. 4 and 5 are top views of the workstation illustrated in FIG. 3 wherein an operator chair on the workstation is illustrated in different positions.
Figure 5:
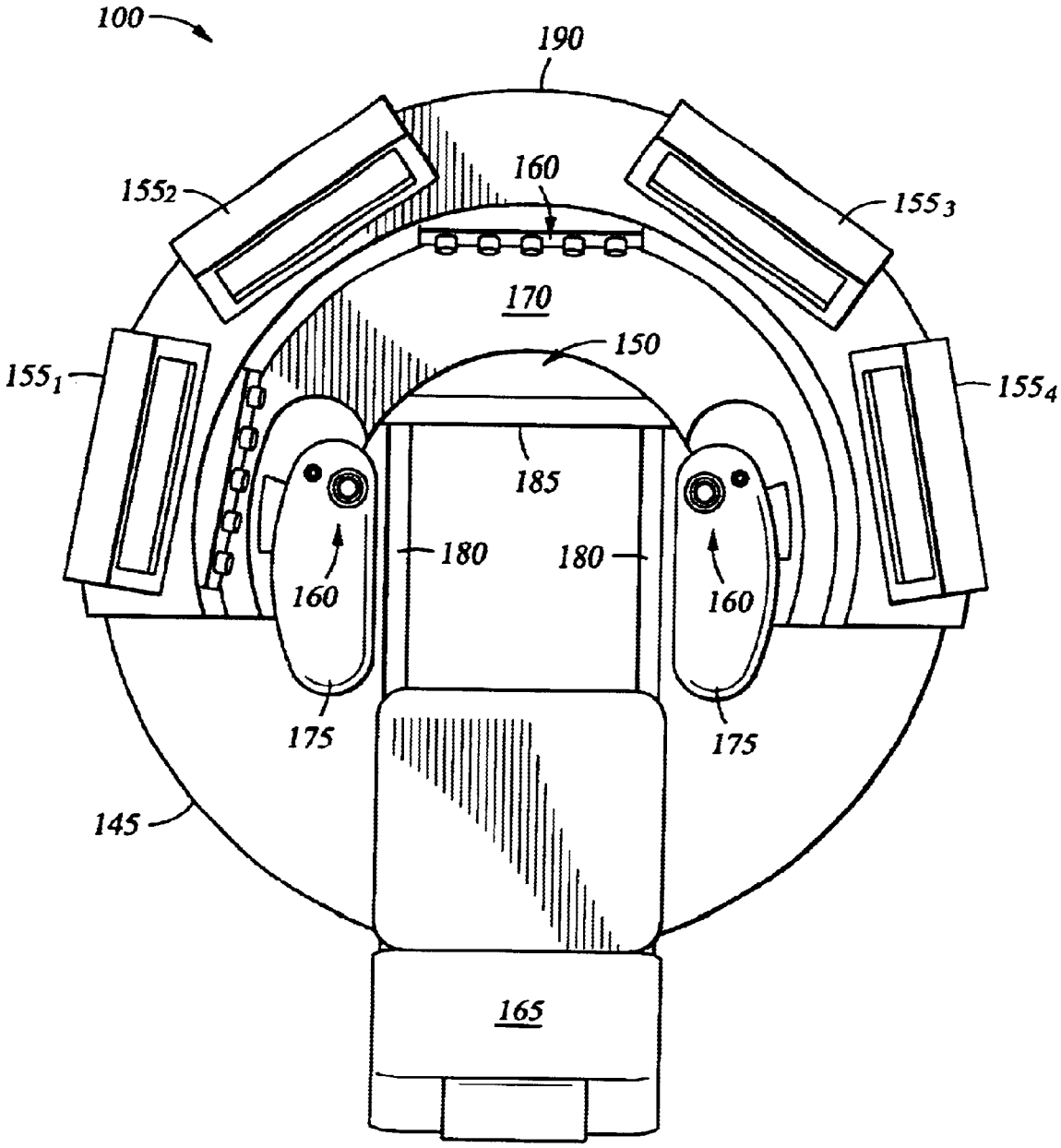

Referring now to FIGS. 3–5, the operator's workstation 100 according to the present invention is illustrated wherein FIG. 3 is an elevation view and FIGS. 4 and 5 are top views of the operator's workstation 100. The workstation 100 is located in proximity to the drilling rig for monitoring and controlling drilling rig operations. The workstation includes an adjustable base 145 which revolves within a substantially 270 degree range and includes an operator alcove 150 formed on the base 145 in which an operator is positioned allowing for a substantially unobstructed view of the drilling rig and drilling rig processes. For example, a primary work panel 170 is attached to the adjustable base 145 wherein the operator alcove 150 is defined by an inwardly cut recess formed in the work panel 170 inwardly of a front edge of the work panel 170. The primary work panel 170 and the operator alcove 150 have, for example, substantially semicircular shapes.

At least one display unit 155 is connected to the base 145. In a preferred embodiment, as shown in FIGS. 3–5, four display units $\mathbf{155}_1$, $\mathbf{155}_2$, $\mathbf{155}_3$, and $\mathbf{155}_4$, respectively, are used. Each display unit 155 has a touch access screen adapted to allow the operator to monitor and control drilling rig processes and at least one of the display units $\mathbf{155}_1$, $\mathbf{155}_2$, $\mathbf{155}_3$, and $\mathbf{155}_4$, displays process oriented data on a current drilling rig process on a display unit 155 within the operator's primary field of vision. The system is interactive through the use of animated color graphic data and control on the LCD touch screen display units 155 integrated into the workstation 100.

The workstation 100 also includes one or more discrete hand controls 160 for controlling certain predetermined drilling rig processes. The hand controls 160 are, for example, switches, pushbuttons, or joystick controls. The discrete hand controls 160 are preferably used for primary operations during a drilling rig process where it is necessary for the operator to maintain visual contact with the operation of the equipment on the drilling rig and for emergency and safety procedures. The display unit 155 screen controls are preferably designed for tool setup or configuration and drilling rig processes where the operator is not required to have visual feedback or where visual feedback is not possible. The touch screen display units 155 are also individually adjustable to maximize operator comfort and visibility and allowing the display units 155 to be ergonomically positioned for each individual operator.

A forearm support panel 175 is formed on opposing sides of the operator alcove 150 for supporting the forearms of the operator while positioned in the alcove 150 and wherein at least one of the discrete hand controls 160, for example, a joystick control, is integrated into at least one of the forearm support panels 175. The forearm support panels 175 are individually adjustable to be ergonomically positioned for maximum operator comfort and to permit both seated operation (shown in FIG. 4) and standing operation (shown in FIG. 5) of the workstation 100. For example, the height of the forearm support panels 175 can be adjusted upwardly to allow comfortable use of the discrete hand controls 160 by the operator in a standing position (shown in FIG. 5) or can be adjusted downwardly to allow comfortable use of the discrete hand controls 160 by the operator in a sitting position (shown in FIG. 4). Other discrete hand controls can also be integrated into the forearm support panels 175 such as switches or knobs. The use of joystick controls located on the forearm support panels 175 is preferably over the use of other types of hand controls where arm fatigue or greater accuracy is a consideration.

An operator chair 165 is positioned in the operator alcove 150 and is slideably connected, for example, at grooves 180, to the base 145 permitting both seated operation (shown in FIG. 4) and standing operation (shown in FIG. 5) of the workstation 100 and controls, and is locked in position as selected by the operator. The height of the operator chair 165 is also adjustable for optimum ergonomics in any position such as, for example, in a standing position while also leaning onto the operator chair 165. The operator in either the seated or standing position to maximize comfort may also use a footrest 185 (shown in FIG. 5). The operator chair 165 also includes various features designed for maximum comfort of the operator such as, for example, a headrest and adjustable lumbar support. The operator chair 165 can also be completely removed from the workstation 100, which also allows for standing operation of the workstation 100 and controls.

The workstation 100 includes individually adjustable base 145, operator chair 165, forearm panels 175, and display units 155 to accommodate a wide range of potential user population such as, for example, average heights ranging from approximately five feet, five inches to six feet, two inches.

A preferred embodiment of the workstation 100 of the present invention is illustrated in FIGS. 3–5 wherein four display units $\mathbf{155}_1$, $\mathbf{155}_2$, $\mathbf{155}_3$, and $\mathbf{155}_4$ are used. The two touch screen display units $\mathbf{155}_2$ and $\mathbf{155}_3$, located toward the front 190 of the workstation 100 in the operator's primary field of vision, are configured for primary operator information pertaining to the current operational drilling rig processes. The data displayed on the display units $\mathbf{155}_2$ and $\mathbf{155}_3$ changes as the operational process changes. The operator selects a pre-defined drilling rig process using, for example, keys illustrated on the display units $\mathbf{155}_2$ and $\mathbf{155}_3$ and custom labeled for each of the predefined processes. The drilling rig processes which can be selected include, for example, rig up and down, actual drilling, reaming, coring, mud conditioning and circulating, trips, rig lubrication, repair, cutting of the drill line, deviation surveys, wire line logs, run casing and cement, testing of blow out preventers, drill stem testing, backing the plug, cement squeezing, fishing and directed work.

For example, the front right display unit $\mathbf{115}_3$ provides dedicated process data formatted as either digital or analog representations, operator selected historical trend data, and a graphical representation of the current operation or process. Superimposed on the graphical representation of the current drilling rig process is, for example, additional digital and status information associated with a current sub-process. The front left display unit $\mathbf{115}_2$ provides, for example, additional data regarding the current drilling rig process and also provides data regarding operator selectable sub-processes. The front left display $\mathbf{115}_3$ is also configured, for example, to accept closed Circuit Television (CCTV) signals and use a picture-in-picture format to allow visual feedback of drilling rig processes that cannot be seen from the rig floor. The remaining display units $\mathbf{155}_1$ and $\mathbf{155}_4$, are located to the left side and right side, respectively, of the operator and are used to display, for example, secondary information such as set-up and configuration data. For example, the left side display unit $\mathbf{155}_1$ is configured to display SCR assignment information and the right side display unit $\mathbf{155}_4$ is configured to display mud system information. Both the side display units $\mathbf{155}_1$ and $\mathbf{155}_4$ provide operator initiated pop-up screens that detail subsystem process set-ups and functions, such as, for example, top drive processes, drawworks processes, and current SCR status information. The system of the present invention provides for data from the current drilling rig process to be presented to the operator within the operator's primary vision, while allowing events associated with the current drilling rig process (i.e. alarms, interlock messages, etc.) to be monitored and displayed on an event basis.

The advantages of the system and workstation of the present invention are illustrated in the display screens of FIGS. 6–12, which show an example of a top drive connection sequence using the system of the present invention. This process is displayed for example, on the front left display unit $\mathbf{115}_2$ wherein the operator can easily maintain visual contact with the operation that is occurring at the drilling rig center. Each of the screens shown in FIGS. 6–12 include a graphical representation of the state of the drilling rig floor, which includes the traveling block assembly, top drive and power slips, and data relevant to this portion of the drilling rig process.

Figure 6:
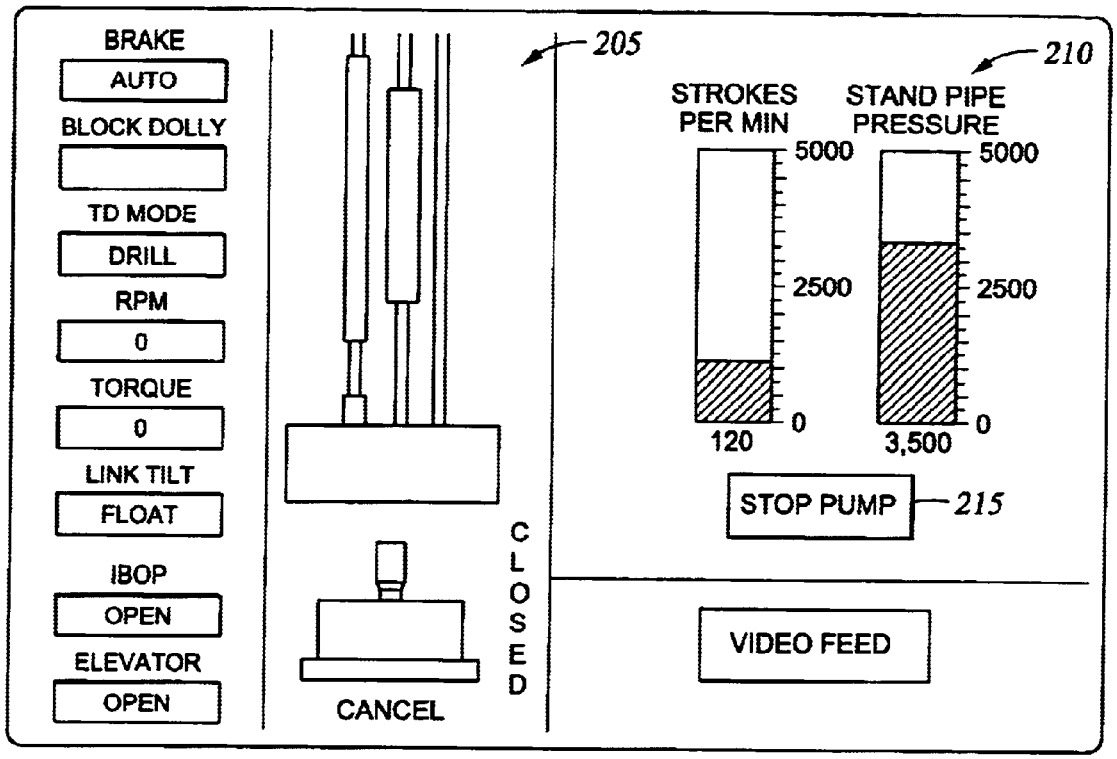
FIGS. 6–12 are display screens illustrating real time drilling rig operational data displayed in a process oriented basis.
Figure 7:
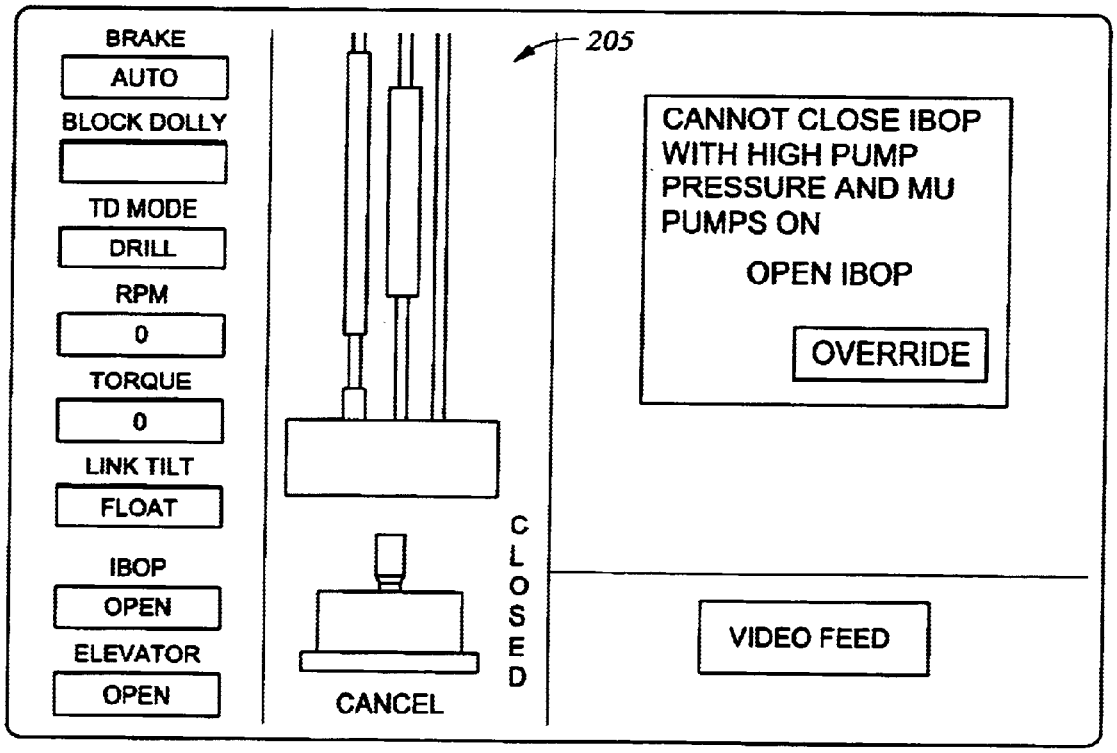

FIG. 6 is the first screen 200 displayed in the process sequence and is presented automatically when the top drive connection sequence is initiated. The screen 200 contains and displays information regarding the state of the drill floor equipment 205, the data relevant at that point in time which includes mud pump speed and pump pressure presented, for example, as bar graphs 210, and a screen control 215 to shut down the mud pumps. Prior to closing the blow out preventer valve (IBOP valve), the operator must insure that the pump pressure is below a preset value in order to prevent washout of the IBOP valve. All of the pertinent data and controls are contained on screen 200 to complete the initial portion of the top drive connection sequence. In the event that the operator attempts to close the IBOP valve before the pump pressure has reached the preset value, a warning message appears as shown in FIG. 7 screen 220.

Figure 8:
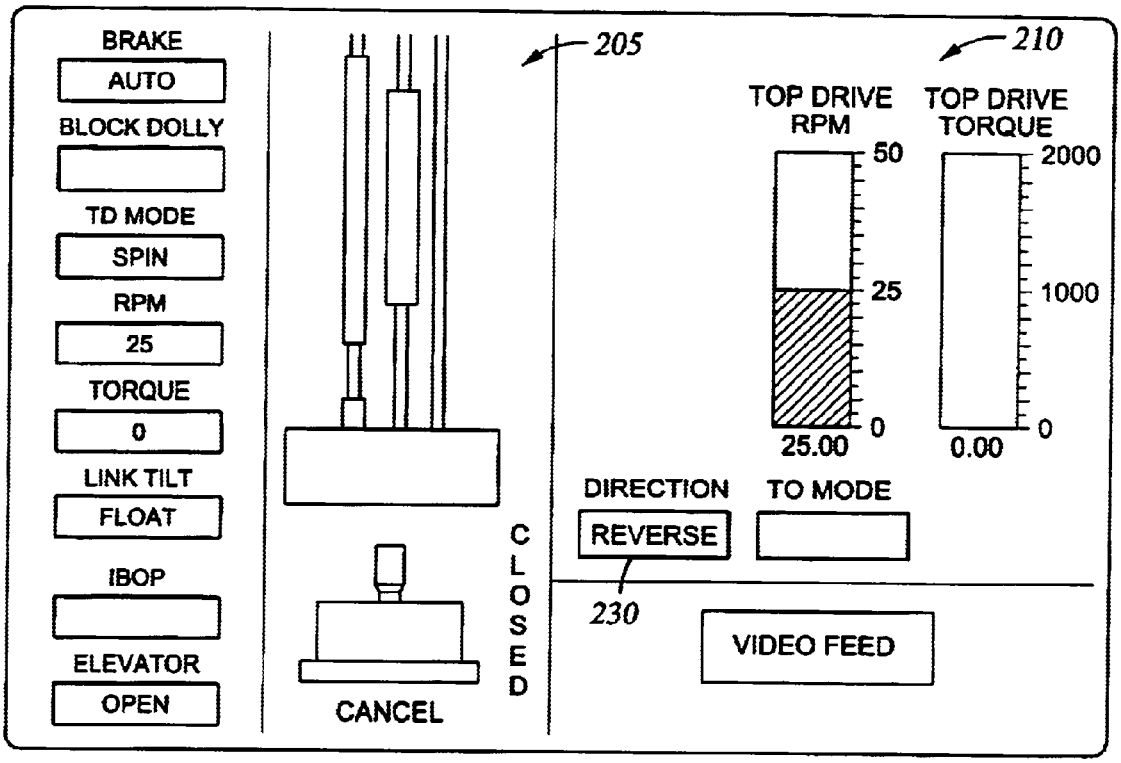
Figure 9:
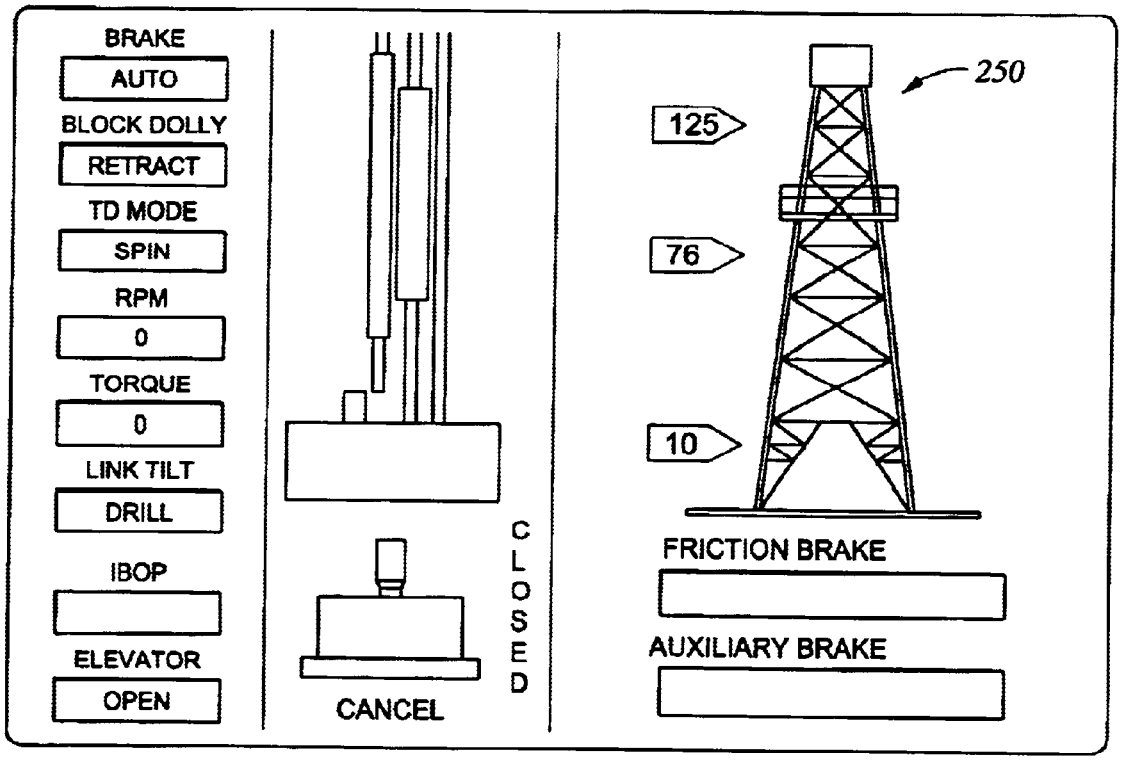

Screen 225 shown in FIG. 8 is displayed when the operator breaks out the connection at the rig floor, and the data relevant at this time includes top drive direction 230, top drive RPM 235, and top drive torque 240. In FIG. 9 screen 245, used as the operator raises the traveling block to the pick up height, displays data including the position of the traveling block in the derrick and the upper and lower set points of the block control system in depiction 250.

Figure 10:
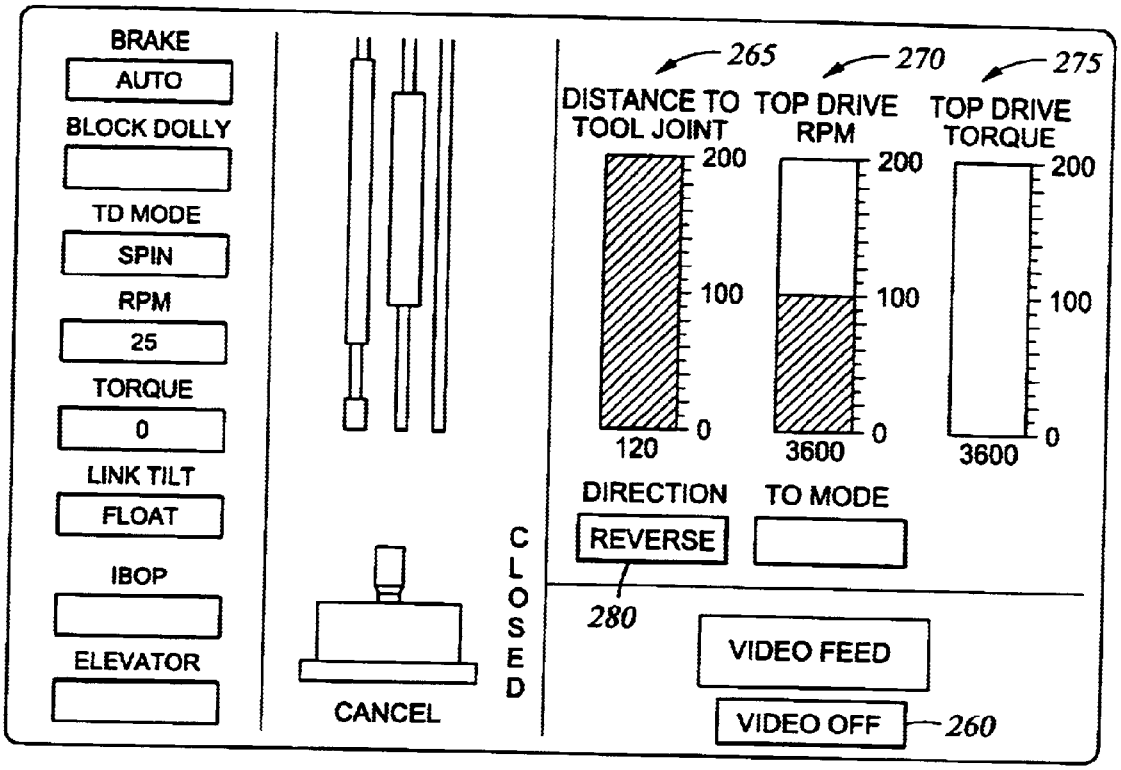
Figure 11:
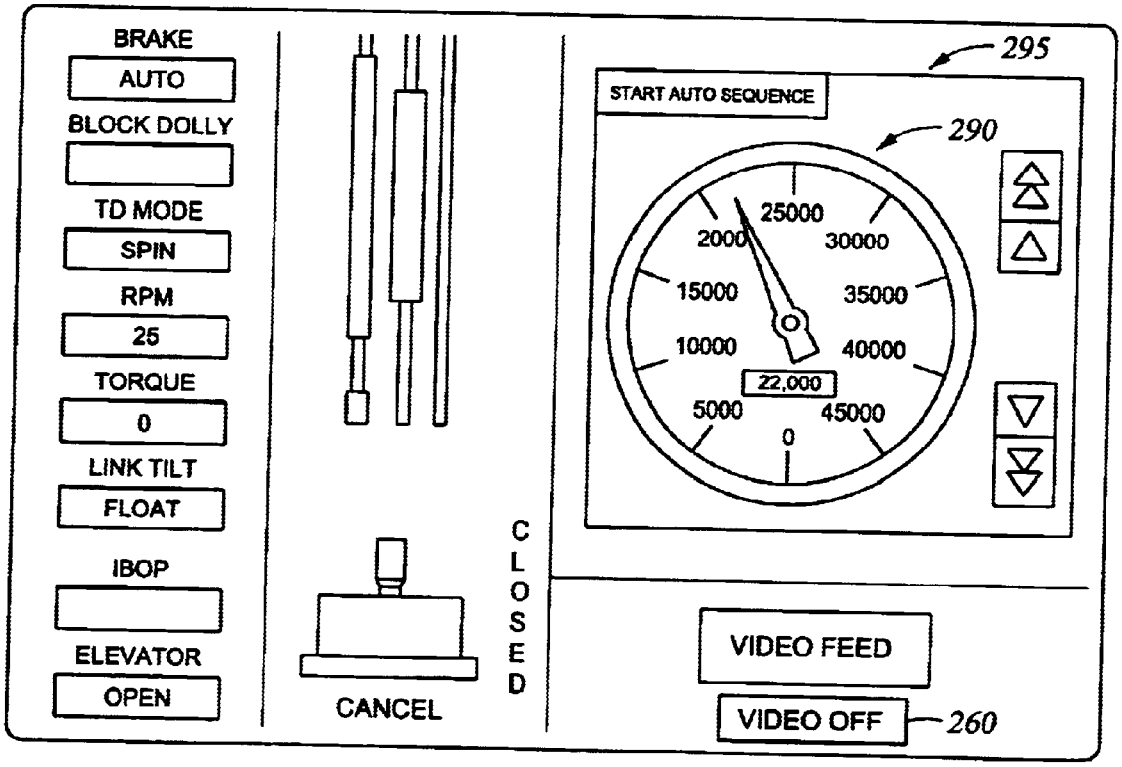
Figure 12:
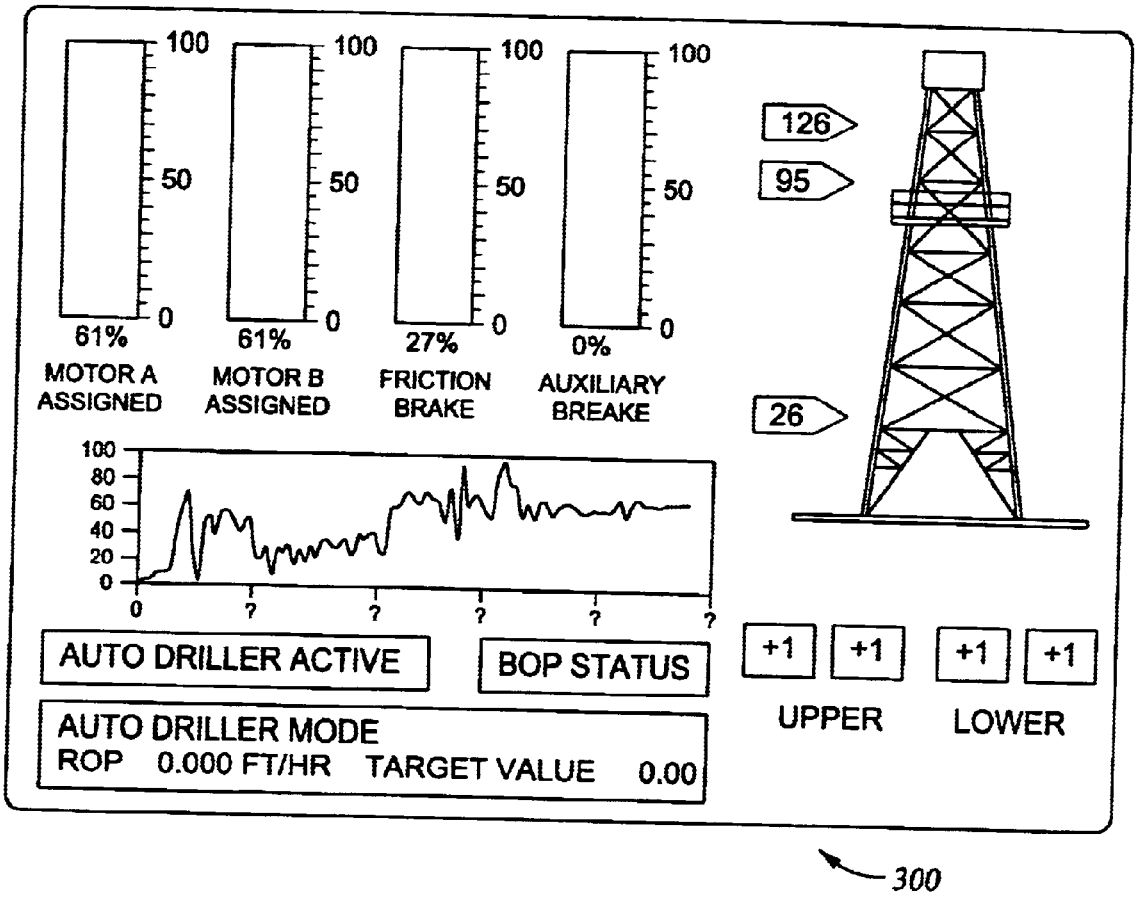

Screen 255 shown in FIG. 10 includes a control 260 for providing a video image from a top drive camera, and the relevant data displayed includes distance to the tool joint 265, top drive RPM 270, top drive torque 275, and top drive direction 280. Screen 285 shown in FIG. 11 includes a torque gage 290 and a control 295 for adjusting the make up toque value and the previous make up toque. FIG. 12 displays the normal drilling ahead screen 300 presented to the operator after the top drive connection sequence is completed.

The overall workstation 100 and process oriented display of current drilling rig processes physically and perceptibly focuses the operator's attention, eyes, and hands onto the most relevant data and drilling operation. This reduces the operating response time and decreases the probability of error. Operator fatigue is also greatly reduced as a function of arm and body support and adjustable positioning. Other significant advantages of the workstation 100 include the relative attitudes of the adjustable base, chair, forearm panels, and display units to accommodate a wide range of potential user population.

While preferred embodiments have been shown and described, various modifications and substitutions may be made thereto without departing from the spirit and scope of the invention. Accordingly it is to be understood that the present invention has been described by way of illustrations and not limitations.

What is claimed is:

1. A workstation system for monitoring and controlling a process on a drilling rig comprising:

a plurality of displays for displaying a graphical representation of a process occurring on a drilling rig, wherein the displays are located toward the front of the workstation in the operator's primary field of vision, and are configured for primary operator information pertaining to the current operational drilling rig process, wherein the data displayed changes as the operational drilling rig process changes;

a plurality of discrete controls for controlling the drilling rig, the controls positioned so that an operator has a direct line of sight to the drilling rig while sifting or standing at the workstation;

a drilling rig information display structured to reduce the quantity of data that must be mentally processed in order to enable the operator to focus on current operational task, rather than data gathering the display further comprising a picture in picture display to allow visual feedback of drilling rig processes that cannot be seen from the rig floor.

2. The workstation system of claim 1 wherein data from various multiple associated well-drilling equipment is integrated with data from the current drilling rig process to provide information on a process-orientated basis wherein said integrated data is displayed on a display to enable a single operator simultaneous access operational access to a plurality of drilling rig processes, the current drilling rig process comprising rig up and rig down, actual drilling, reaming, coring, mud conditioning and circulating, trips, rig lubrication, repair, cutting of the drill line, deviation surveys, wire line logs, run casing and cement, testing of blow out preventers, drill stem testing, backing the plug, cement squeezing, fishing and directed work.

3. The workstation system of claim 1 wherein a process orientated display of rig site information relieves the operator of the necessity of scanning many parameters located on dispersed control panels, while simultaneously trying to control and mentally assemble a cohesive picture of the current drilling rig operation, wherein the discrete controls are located between information displays in the operator's primary field of vision so that the operator has a direct line of sight to the drilling rig while sitting or standing at the workstation.

4. A workstation system for monitoring and controlling a process on a drilling rig comprising:

a plurality of displays for displaying a graphical representation of a process occurring on a drilling rig, wherein the displays are located toward the front of the workstation in the operator's primary field of vision, and are configured for primary operator information pertaining to the current operational drilling rig process, wherein the data displayed changes as the operational drilling rig process changes;

a plurality of discrete controls for controlling the drilling rig, the controls positioned so that an operator has a direct line of sight to the drilling rig while sitting or standing at the Workstation; an adjustable base; and an operator alcove formed on the base and positioned to allow an operator an unobstructed view of the drilling rig;

a first display displaying a graphical representation of the state of the drilling rig floor comprising a traveling block assembly, top drive, power slips and data relevant to this portion of the drilling rig process; and a second display for displaying information regarding the state of the drill floor equipment; and displaying the data relevant at that time comprising mud pump speed and pump pressure comprising a bar graph for pump speed and pump pressure.

5. The workstation of claim 4 further comprising:

a screen control display to optionally shut down to mud pumps.

6. The workstation of claim 4 further comprising:

a warning message displayed when the operator tries to close a blow out prevention before the pump pressure has reached a preset value.

7. The workstation of claim 4 further comprising data displayed relevant at the time when the operator breaks out of a connection at the rig floor, the data comprising top drive direction, top drive RPM and top drive torque; and a data display comprising the position of the traveling block in the derrick and the upper and lower set point of the block control system in the rig graphical representation when the operator raises the traveling block to pick up height.

8. The workstation of claim 4 further comprising:

a video image from a top drive camera, displaying on a display, relevant data comprising distance to a tool joint, top drive RPM, top drive torque, and top drive direction;

a torque gauge display and a control for adjusting the make up torque value and the previous make up torque; and a normal drilling ahead screen displayed to the operator after top drive connection sequence is completed.

* * * * *